United States Patent [19]

Deuse

[11] Patent Number: 4,815,860

[45] Date of Patent: Mar. 28, 1989

[54] METHOD AND DEVICE FOR THE CONTINUOUS DOSING OF POWDERY SUBSTANCES BY MEANS OF HIGH-PRESSURE GAS

[75] Inventor: Thomas Deuse, Offenback, Fed. Rep. of Germany

[73] Assignee: Degussa Aktiengesellschaft, Frankfurt, Fed. Rep. of Germany

[21] Appl. No.: 184,086

[22] Filed: Apr. 20, 1988

[30] Foreign Application Priority Data

Apr. 30, 1987 [DE] Fed. Rep. of Germany ..... 3714387

[51] Int. Cl.[4] ..... B28C 5/06; B01F 13/02

[52] U.S. Cl. ..... 366/3; 366/10; 366/101; 366/159

[58] Field of Search ..... 366/2, 3, 5, 10, 11, 366/101, 106, 107, 136, 137, 138, 159, 160, 162; 118/311

[56] References Cited

U.S. PATENT DOCUMENTS 1,684,370 9/1928 Schuster ..... 366/5
3,625,724 12/1971 Alvero ..... 366/10
3,779,519 12/1973 Anderson ..... 366/3
4,440,499 4/1984 Tomikawa ..... 366/10

*Primary Examiner*—Robert W. Jenkins
*Attorney, Agent, or Firm*—Beveridge, DeGrandi & Weilacher

[57] ABSTRACT

Method for the continuous dosing of powdery substances, preferably synthetic silica, by means of high-pressure gas, especially by mean of compressed air, in which in a multiple, at least double line the supply of high-pressure gas is alternatingly interrupted in a branch line, the powdery substance is filled into the branch line and the powdery substance is subsequently transported further by the high-pressure gas. Device for the continuous dosing of powdery substances by means of compressed gas, which is arranged so that a multiple, at least double line which comes together again after branching is provided with a throttle valve and a nonreturn valve in the branch lines in the direction of flow of the high-pressure gas, whereby the branch lines are connected via a throttle valve to a storage silo for the powdery substance and also to an aeration tube.

7 Claims, 3 Drawing Sheets

METHOD AND DEVICE FOR THE CONTINUOUS DOSING OF POWDERY SUBSTANCES BY MEANS OF HIGH-PRESSURE GAS

INTRODUCTION AND BACKGROUND

The present invention relates to a method and a device for the continuous dosing of powdery substances, especially of powdery synthetic silica, by means of high-pressure gas.

The use of air-sprayed concrete (shotcrete) in building construction and foundation work, especially in tunnel construction, is known (cf. S+t 40, 1986, p. 3).

The setting action of air-sprayed concrete (shotcrete) is spontaneously increased by the addition thereto of synthetic silica, which is clearly noticeable in an increase of the adhering amount of concrete and a lesser rebound or fell off. The concrete removed from the wall displays a reduction in the degree of spreading or slumping of 20 to 25% compared to a concrete which contains no synthetic silica.

The addition and the exact dosing of the synthetic silica into the air-sprayed concrete (shotcrete) during application involves considerable problems. Thus, for example, the synthetic silica is conducted next to the concrete mass and the delivery air via a third supply line directly to the spraying nozzle.

However, the mixing which can be achieved thereby is totally insufficient, which can be noticed from the mist of silica at the exit point from the nozzle.

It would probably be more advantageous to add the silica directly into the stream of delivery air.

However, this can not be accomplished with the known pumps, such as e.g. Depa pumps because the pressure in the air line during operation is approximately 8 bars.

SUMMARY OF THE INVENTION

It is an object of the invention to provide a method for precisely dosing the addition of synthetic silica into air-sprayed concrete (shotcrete) and of homogeneously mixing the silica with the air-sprayed concrete (shotcrete) to be air-sprayed.

In more particular detail, it is a feature of the invention to provide a method for the continuous dosing of powdery substances, especially synthetic silica, by means of high-pressure gas, preferably compressed air. In carrying out this process, there is employed a multiple line for conveying the high-pressure gas. At least a dual conduit system is employed. The volume supply of the high-pressure gas is alternatingly interrupted in each of the branch lines, the powdery substance is filled by a conduit connected into the branch line and the powdery substance is subsequently transported further by action of the high-pressure gas in the branch lines.

In a preferred embodiment of the invention, the supply line carrying the high-pressure gas can be designed with quadruple branch lines; that is, four lines arranged in two pairs.

In order to avoid a back flow or reverse flow of the high-pressure gas from the junction of the multiple lines back into the branch line during the interruption of the supply of high-pressure gas, the branch line can be closed off by a nonreturn or one-way valve that enables control over the flow in the undesired direction.

During the filling of the branch line, the excess pressure generated can be compensated for or equalized via a throttle valve and another line, e.g. into the silo which contains the powdery substance.

The transport of the powdery substance from the silo into the branch line can be performed by known means, e.g. a pump.

Such pump means are described in the series "Pigmente der Degussa AG Frankfurt" [Pigments of Degussa AG Frankfurt], No. 70 published in December, 1978.[1]

[1] "Technical Bulletin Pigments", No. 70 Degüssa AG, Frankfurt published in September 1979.

The closing of the branch lines can be performed by means of known throttle valves.

Another feature of the present invention resides in a device for the continuous dosing of powdery substances, especially synthetic silica, by means of high-pressure gas. The device is characterized by a multiple pipeline system formed of at least a double line which comes together again on the downstream end after branching and which is provided with a throttle valve and a nonreturn or one-way valve in the branch lines in the direction of flow of the high-pressure gas. The branch lines are connected via a throttle valve to a storage silo or bin for the powdery substance and also to an aeration pipe.

The method of the invention has the advantage that the powdery substance is homogeneously mixed with the concrete in a continuous manner without loss of substance. The silica is dispersed in the concrete in a uniform and homogeneous manner.

BRIEF DESCRIPTION OF THE INVENTION

The method and the device of the invention will now be explained in more detail with reference to the accompanying drawings, wherein.

DETAILED DESCRIPTION OF INVENTION

Figure 1:
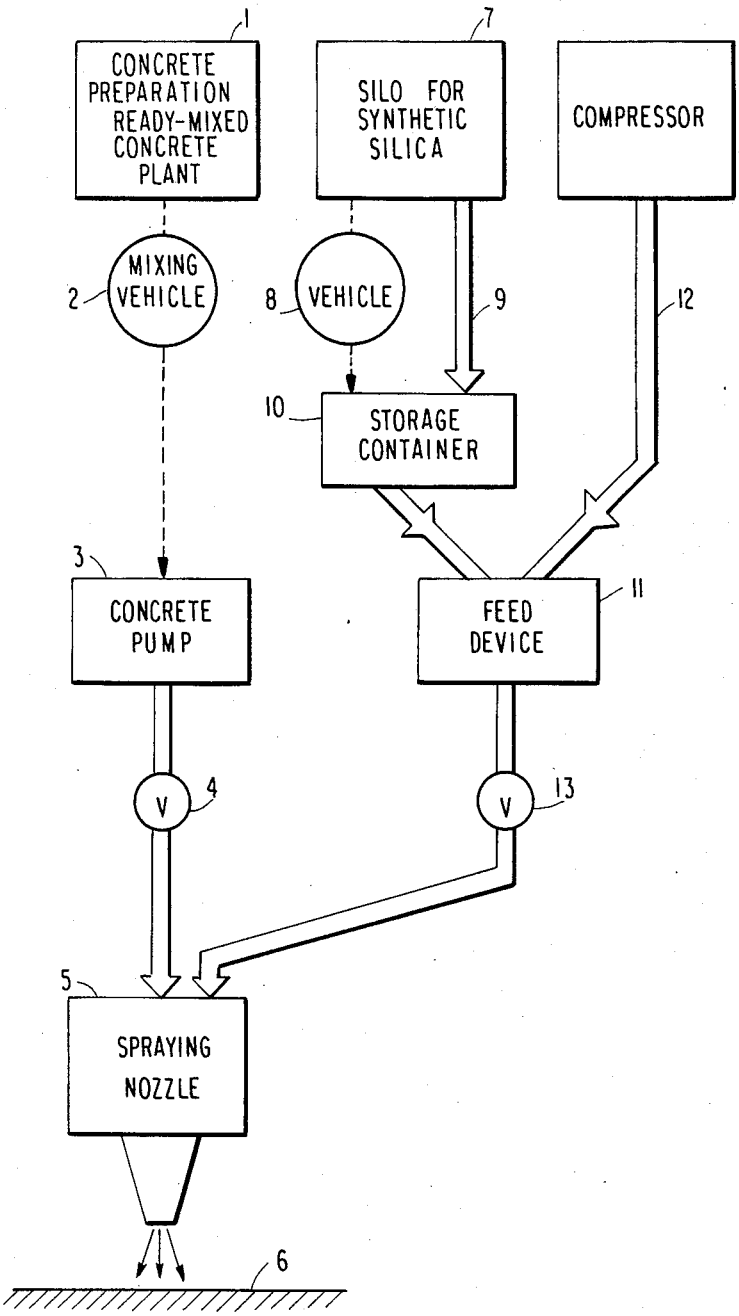
FIG. 1 shows the schematic arrangement of the apparatus used in the application of air-sprayed concrete (shotcrete)

According to FIG. 1, the concrete is transported from a typical ready-mixed concrete manufacturing plant 1 by conventional mixing vehicle 2, such as a concrete truck, to concrete pump 3.

Concrete pump 3 delivers the concrete via valve 4 to spraying nozzle 5. From there, concrete is applied onto wall 6 according to known techniques.

The synthetic silica is delivered from a storage means, such as silo 7 by vehicle 8 or, alternatively, via vertical line 9 into storage container 10 and from there into feed device 11.

Compressed air is conducted from the compressor via line 12 into feed device 11.

The synthetic silica is transported by the compressed air from feed device 11 via valve 13 into spraying nozzle 5 and mixed in spraying nozzle 5 with the concrete.

Figure 2:
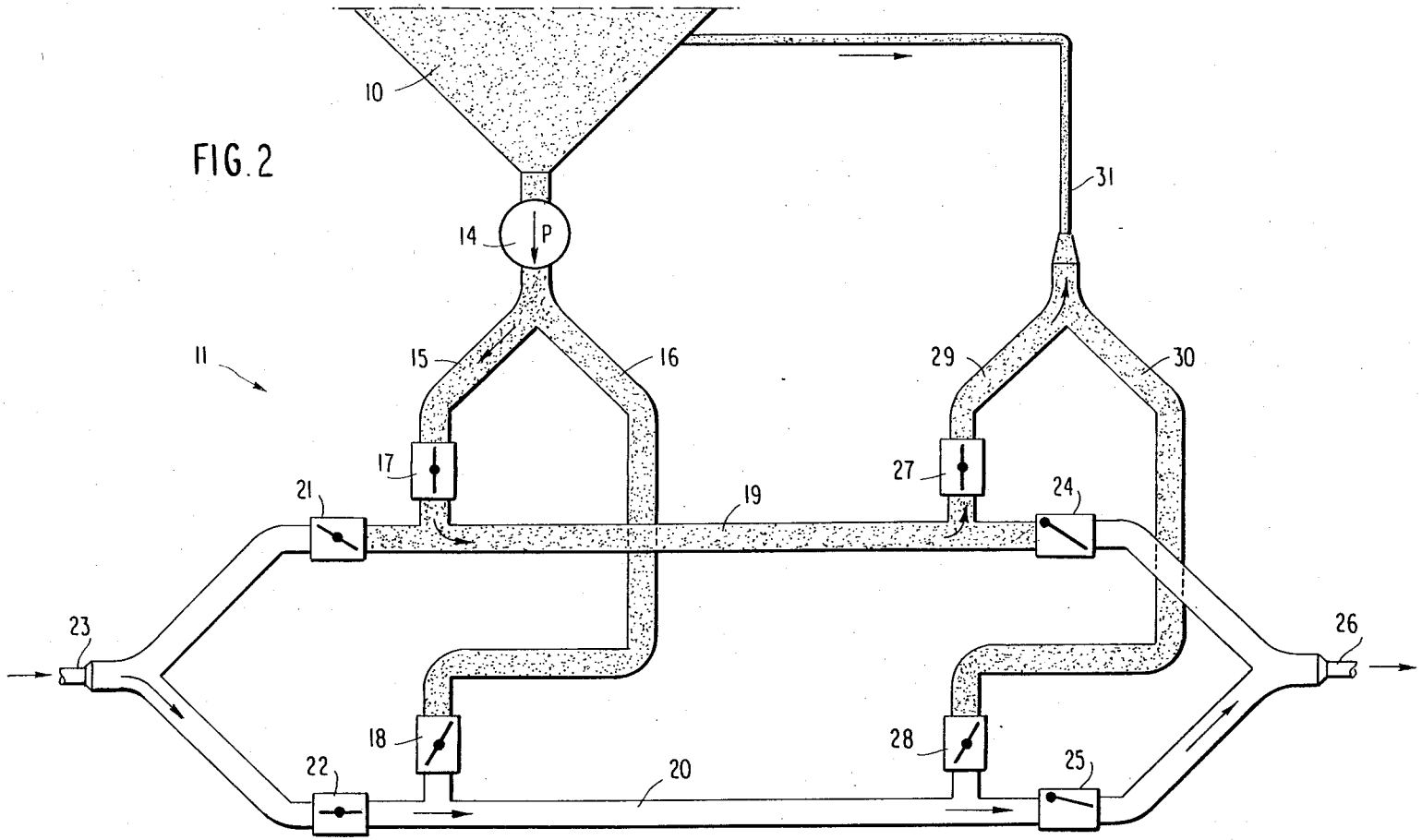
FIG. 2 shows the feed device of the invention.

As shown in FIG. 2, the synthetic silica is pumped from storage container 10 by pump 14 into branched pipelines 15,16. Each of the branched pipelines carrying the finely divided powder is separately connected to one of the pipelines carrying the pressurized gas. Pipelines 15,16 are each provided with its own throttle valve 17, 18. Each of the powder supply pipelines 15,16 is connected to one of the gas supply branch lines 19,20 via a separately controllable throttle valve 17,18. The dual branch lines 19,20 are each provided with a throttle valve 21,22 and hose line 23 which supplies the gas.

At the downstream end, branch lines 19,20 are each fitted with a nonreturn (one-way) valve 24,25 and are joined to each other downstream from the one-way valves to form hose line 26.

Supply hose line 23 is connected to the gas compressor and conveys the compressed air or other gas into the feed device.

The exiting hose line 26 is connected to valve 13 and conducts the mixture of synthetic silica and compressed air via valve 13 into spraying nozzle 5; see FIG. 1.

In addition, branch lines 19,20 are provided downstream from the entry point of powder supply lines 15,16 for hook up to recycle lines 29,30. Throttle valves 27,28 are fitted into recycle lines 29,30, which are joined together in line 31 which, in turn, is connected to storage container 10.

The feed of the synthetic silica into the current of compressed air occurs in alternating fashion via throttle valves 17,18 into branch lines 19,20.

Throttle valves 21,22 as well as throttle valves 27,28 are actuated as the same time.

In operating the process of the invention, when the synthetic silica is introduced via open throttle valve 17 into branch line 19, throttle valve 21 is closed and throttle valve 27 is open. Nonreturn valve 24 is closed.

The excess pressure that occurs during the filling of pipeline 19 is compensated for and equalize via lines 29,31 into storage container 10.

The current of compressed air is conducted at the same time via open throttle valve 22 and open nonreturn valve 25 into hose line 26 through branch line 20 and past branch line 19. Throttle valves 18,28 are closed at that time.

All throttle valves and nonreturn valves are actuated simultaneously in the following cycle of operation.

Valve 21 is opened and the current of compressed air transports the synthetic silica from branch line 19 via open nonreturn valve 24 into hose line 26.

At the same time, branch line 20 is filled with synthetic silica via open throttle valve 18.

The speed-determining step is the filling of branch lines 19 or 20 with synthetic silica.

Figure 3:
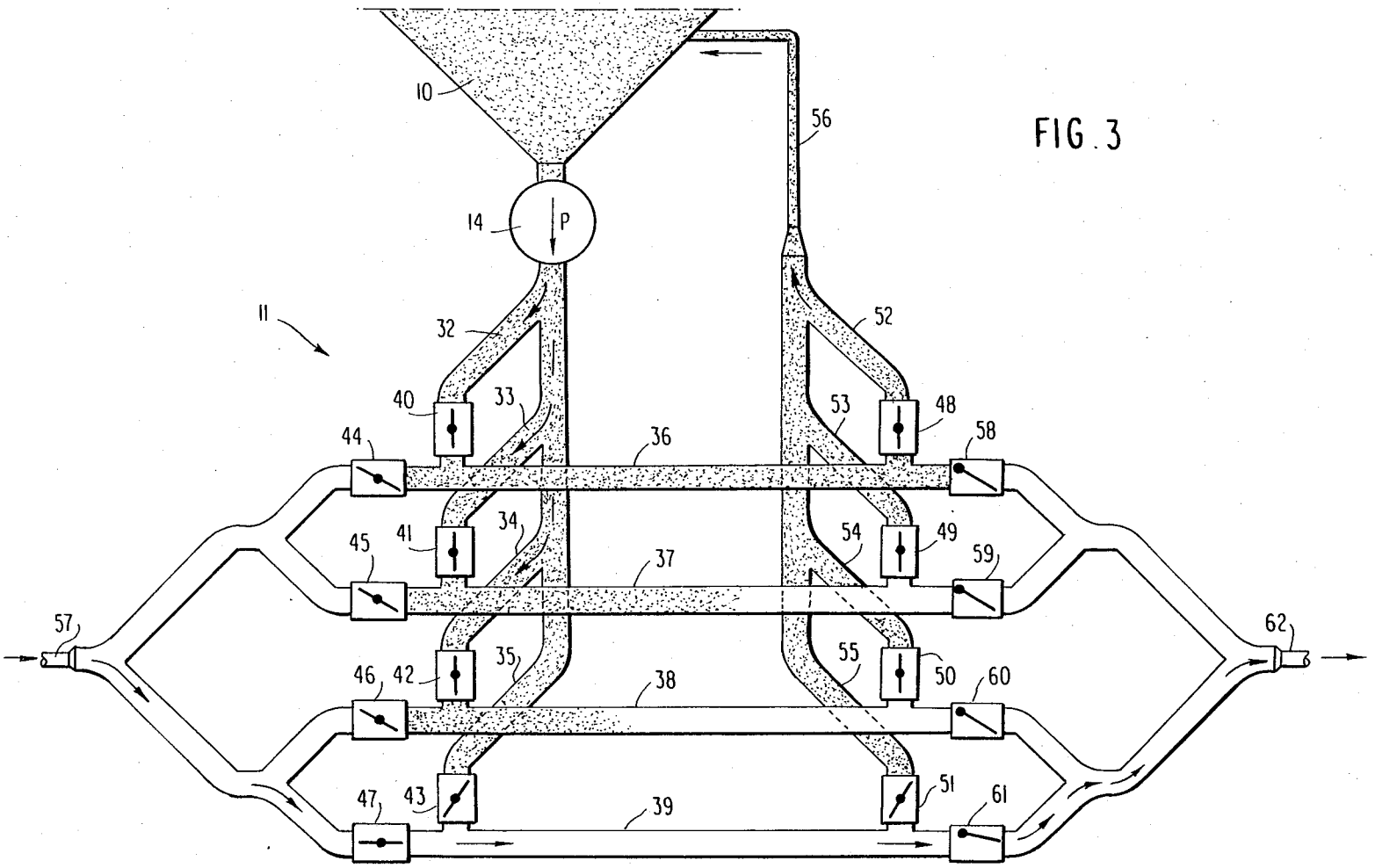
FIG. 3 shows another embodiment of the feed device of the invention.

According to FIG. 3, the synthetic silica is pumped from storage container 10 by pump 14 into multiple pipelines 32,33,34 and 35.

The supply of synthetic silica to branch lines 36,37,38 and 39 occurs via throttle valves 40,41,42 and 43.

The supply of compressed air to branch lines 36,37,38 and 39 occurs via throttle valves 44,45,46 and 47.

The excess pressure which accumulates during the filling of branch lines 36,37,38 and 39 with synthetic silica is equalized via throttle valves 48,49,50 and 51 and lines 52,53,54,55 and 56 into storage container 10.

Compressed air is supplied from the compressor via line 57.

Branch lines 36,37,38 and 39 are closed while being filled with synthetic silica by nonreturn valves 58,59,60 and 61. The mixture of compressed air and synthetic silica is conducted out of the feed device via line 62.

The device according to FIG. 3 comprises four branch lines which can be filled with synthetic silica instead of the two in the device according to FIG. 2. The four branch lines are arranged as two pairs.

Since the filling with synthetic silica is the speed-determining step, the device of FIG. 3 can achieve a more rapid loading of the compressed air with synthetic silica.

In order to achieve an even loading of the compressed air with synthetic silica, the device of FIG. 3 is operated in a 4-cycle [4-stroke] operation.

The silica used as synthetic silica in the method of the present invention can be any of those described in the art, such as by Winnacker-Kochler, Chemische Technologie, vol. 3, Anorganische Technologie II, 4th edition, Carl Hauser Verlag, Munich/Vienna, 1983, pp. 75 to 90.

Of particular importance are pyrogenic silicas prepared by flame hydrolysis as well as precipitated silicas. Precipitated silicas are preferred in the method of the invention. These are all well known substances whose methods of production are described in the art.

The precipitated silicas can be added unground or steam-jet ground, and spray-dried or spray-dried and ground. Such techniques are known in the art.

For example, the following precipitated silica can be used, wherein the precipitated silica FK 320 DS is preferred.

| | | | FK 320 DS | Duro-sil | Sipernat 22 | Sipernat 22 S |
|---|---|---|---|---|---|---|
| surface area BET | 1) | $m^2/g$ | 170 | 60 | 190 | 190 |
| average size of primary particles | | nm | 18 | 40 | 18 | 18 |
| stamping density | 2) | g/l | 80 | 210 | 270 | 120 |
| pH | 3) | | 6.3 | 9 | 6.3 | 6.3 |
| sieve residue (acc. Mocker 45 μm | 4) | % | 0.01 | 0.3 | 0.5 | 0.1 |
| drying loss (2h, 105° C.) | 5) | % | 6 | 6 | 6 | 6 |
| ignition loss (2h, 1000° C.) | 5)6) | % | 5 | 6 | 5 | 5 |
| $SiO_2$ | 7) | % | 98 | 98 | 98 | 98 |
| $Na_2O$ | 7) | % | 1 | 1 | 1 | 1 |
| $Fe_2O_3$ | 7) | % | 0.03 | 0.03 | 0.03 | 0.03 |
| $SO_3$ | 7) | % | 0.8 | 0.8 | 0.8 | 0.8 |

1) according to DIN 66 131.
2) according to DIN 53 194 (non-sieved), ISO 787/XI or JIS K 5101/18.
3) according to DIN 53 2OO (in 5% aqueous dispersion), ISO 787/IX, ASTM D 1208 or JIS K 5101/24.
4) according to DIN 53 580, ISO 787/XVIII or JIS K 5101/20.
5) according to DIN 55 921, ASTM D 1208 or JIS K 5101/23.
6) in relation to the substance dried 2 hours at 105° C.
7) in relation to the substance annealed 2 hours at 1000° C.
8) in water: methanol = 1:1.
9) contains approximately 3% chemically bound carbon.
10) contains approximately 2% chemically bound carbon.

| | | | Extrusil |
|---|---|---|---|
| surface area (BET) | 1) | $m^2/g$ | 35 |
| average size of primary particles | | nm | 25[9)] |
| stamping density | 2) | g/l | 300 |
| pH | 3) | | 10 |
| sieve residue (acc. Mockker 45 μm) | 4) | % | 0.2 |
| drying loss (2 h, 105° C.) | 5) | % | 6 |
| ignition loss (2 h,, 1000° C.) | 5)6) | % | 7 |
| $SiO_2$ | 7) | % | 91 |
| $Al_2O_3$ | 7) | % | 0.2 |
| CaO | 7) | % | 6 |
| $Na_2O$ | 7) | % | 2 |
| $Fe_2O_3$ | 7) | % | 0.03 |
| $SO_3$ | 7) | % | — |

-continued

| | | | Extrusil |
|---|---|---|---|
| Cl− | 7) | % | 0.8 |

1) according to DIN 66 131.
2) according to DIN 53 194 (non-sieved), ISO 787/XI or JIS K 5101/18.
3) according to DIN 53 200 (in 5% aqueous dispersion), ISO 787/IX, ASTM D 1208 or JIS K 5101/24.
4) according to DIN 53 580, ISO 787/XVIII or JIS K 5101/20.
5) according to DIN 55 921, ASTM D 1208 or JIS K 5101/23.
6) in relation to the substance dried 2 hours at 105° C.
7) in relation to the substance annealed 2 hours at 1000° C.
8) cannot be measured in reproducible fashion.
9) the size of the primary particles cannot be precisely determined in the case of silicates on account of heavy intergrowths.
10) total ignition loss, 1 h 800° C.
11) in relation to the substance annealed 1 h at 800° C.

The determination of the physical and chemical characteristic data is made according to the following methods:

pH (according to DIN 43 200)

The pH is determined electrometrically with a glass electrode and a pH meter. The pH of silica is generally in the neutral range whereas that of silicates is in the slightly alkaline range.

Sieve residue (according to DIN 43 580)

The sieve residue is an indicator for the degree of granularity. In order to detect the amounts of components which can not be dispersed or can only be dispersed with difficulty occurring in very minute amounts in precipitated silica and silicates, the sieve residue is determined according to Mocker. In this method, a silica suspension is washed with 4 bars water pressure through the sieve. The sieve is then dried and the sieve residue weighed out [tared]. 45-micrometer sieves are used which correspond to 325 meshes (according to ASTM).

Surface according to BET (DIN 66 131)

The surface of silica and silicates is measured according to the BET method in $m^2/g$.

The method is based on the adsorption of gaseous nitrogen at the temperature of liquid nitrogen. The area meter method according to Haul and Dumbgen can be used with advantage. A calibration is required. Both the "inner" and the "outer" surface are determined.

Average size of the primary particles

The average size of the primary particles can be determined with photographs by electron microscopes. To this end, the diameters of approximately 3,000–5,000 particles are determined and their arithmetical average calculated. The individual primary particles are generally not present in isolated form but rather are combined to aggregates and agglomerates. The "agglomerate" particle size of precipitated silicas and silicates is a function of the grinding process.

Stamping density (according to DIN 53 194)

This is an indication of measurement for the weight of the powdery product. Approximately 200 ml silica are stamped in the measuring cylinder of the stamping volumeter 1,250 times. The stamping density is calculated from the weight of the material and the volume and indicated in g/l.

Drying loss (according to DIN 55 921)

The precipitation products contain a small amount of physically bound water. After 2 hours drying in an air oven at 105° C., the bulk of the physically bound water has been removed.

Annealing [ignition] loss (according to DIN 55 921)

After 2 hours annealing time at 1000° C., the water chemically bound in the form of silanol groups has also been removed. The annealing loss is determined with the substance dried 2 h at 105° C.

Precipitated silica FK 320 DS is a precipitated silica (silicic acid) which was steam-jet ground after rotary drying.

Precipitated silica Durosil is an unground, rotary-dried, precipitated silica.

Precipitated silica Sipernat 22 is a spray-dried, precipitated silica.

Precipitated silica Sipernat 22 S is a spray-dried and ground, precipitated silica.

Further variations and modifications of the foregoing will be apparent to those skilled in the art and are intended to be encompassed by the appended claims.

German priority application No. P 37 14 387.5-25 is incorporated and relied on herein.

We claim:

1. A method for the manufacture of sprayable concrete (shotcrete) containing a finely divided powdery substance dispersed therein comprising providing a supply of sprayable concrete (shotcrete) and a supply of finely divided powdered material, providing storage means for the powdered material and a source of compressed gas, conveying said compressed gas in conveying means which is branched to provide at least a double essentially parallel pipeline conveying means, conveying said powdered means to a branched pipeline, said branched pipeline being fitted to a separate line of said at least double pipeline for carrying the high pressure gas, the supply of high pressure gas being alternatingly interrupted for introduction into said at least double branched pipelines, filling the powdery substance into said conveying means and alternatingly introducing the powder means into the compressed gas pipeline means which is then conveyed to the spraying means.

2. The method in accordance with claim 1 wherein the high pressure gas is air.

3. The method according to claim 1 wherein the conveying means of the powder is made up of a branched pipeline fitted with throttle means and for connecting up with individual members of the branched pressurized gas line.

4. The method of claim 3 wherein said dual pipelines are fitted with one-way valve means for preventing back flow of pressurized gas during intermittent operation of said pressurized gas.

5. The method according to claim 1 wherein the gas and powdered substance are at least partly recycled to means for storing said powdered means.

6. The method according to claim 4 further comprising introducing the powdered finely divided material through valve means in a conduit into a branch conduit attached to compressed gas means, closing throttle valve means located in said second member of said dual branched conveying means and opening throttle means in said recycle pipeline, closing said one-way valve in said second branch of said air conduit means, equalizing excess pressure resulting from the filling of said pipeline with said powdery means, conducting a current of compressed gas simultaneously by means of open valve means in said first of said dual pipelines, said one-way valve in said first pipeline being open, the control valves in the recycle conduit being closed.

7. The method in accordance with claim 1 wherein the control valve in said second branch of said dual pipeline is open and conducting a current of compressed air through the second line of said dual pipeline into a hose line at said downstream side.

* * * * *